United States Patent [19]

Le

[11] Patent Number: 4,735,329

[45] Date of Patent: Apr. 5, 1988

[54] EMERGENCY FLASK FOR LIFE PRESERVERS

[76] Inventor: Ha M. Le, 3211 E. 61st St., Long Beach, Calif. 90805

[21] Appl. No.: 49,846

[22] Filed: May 15, 1987

[51] Int. Cl.[4] ..... B65D 47/04

[52] U.S. Cl. ..... 215/229; 215/1 A; 215/100 R

[58] Field of Search ..... 215/229, 1 A; 220/90.2

[56] References Cited

U.S. PATENT DOCUMENTS

| | | | |
|---|---|---|---|
| 3,416,687 | 12/1968 | Arnaud | 215/100 A |
| 4,244,477 | 1/1981 | Seel | 215/229 |
| 4,448,316 | 5/1984 | Hiroshige | 215/229 X |

FOREIGN PATENT DOCUMENTS

| | | | |
|---|---|---|---|
| 653199 | 5/1951 | United Kingdom | 215/1 A |

*Primary Examiner*—Donald F. Norton

*Attorney, Agent, or Firm*—Julius Rubinstein

[57] ABSTRACT

A flask for attachment to a life preserver is provided with a coiled straw inside the flask. The flask is covered by a cap through which the end portion of the straw is adapted to extend. The cap has a valve mechanism which is attached to the end portion of the straw and pinches the end portion of the straw shut to prevent the entrance of sea water in the flask. A spring is attached to the valve mechanism in such a way that some force is required to actuate the valve mechanism so it no longer pinches the end portion of the straw shut. When this force is exerted on the spring, the valve mechanism releases the end of the straw so the person in the water can suck the contents of the flask through the straw. If the person in the water faints and no longer exerts this force on the valve mechanism, the spring automatically actuates the valve mechanism to pinch the end portion of the straw shut, to prevent the entrance of sea water into the flask and thus preserve its contents.

6 Claims, 1 Drawing Sheet

FIG. 1.
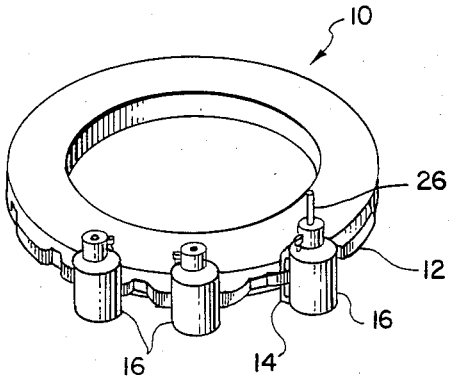
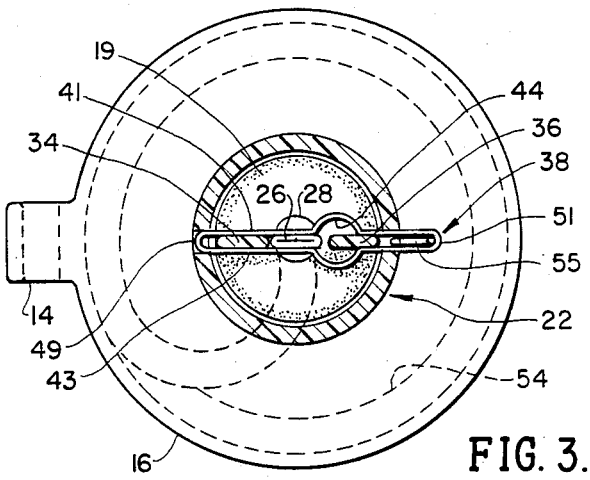
FIG. 3.
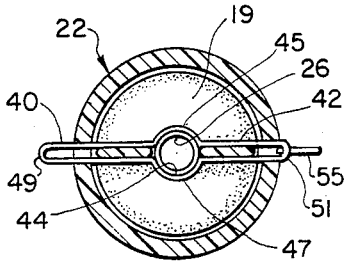
FIG. 4.
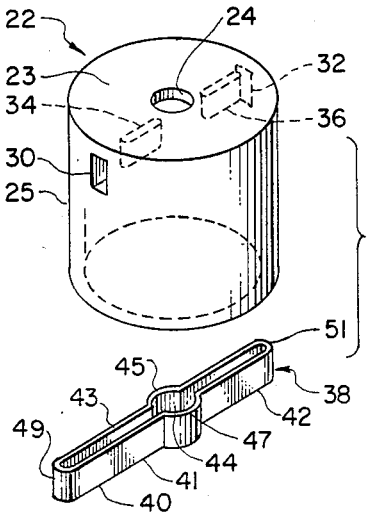
FIG. 5.
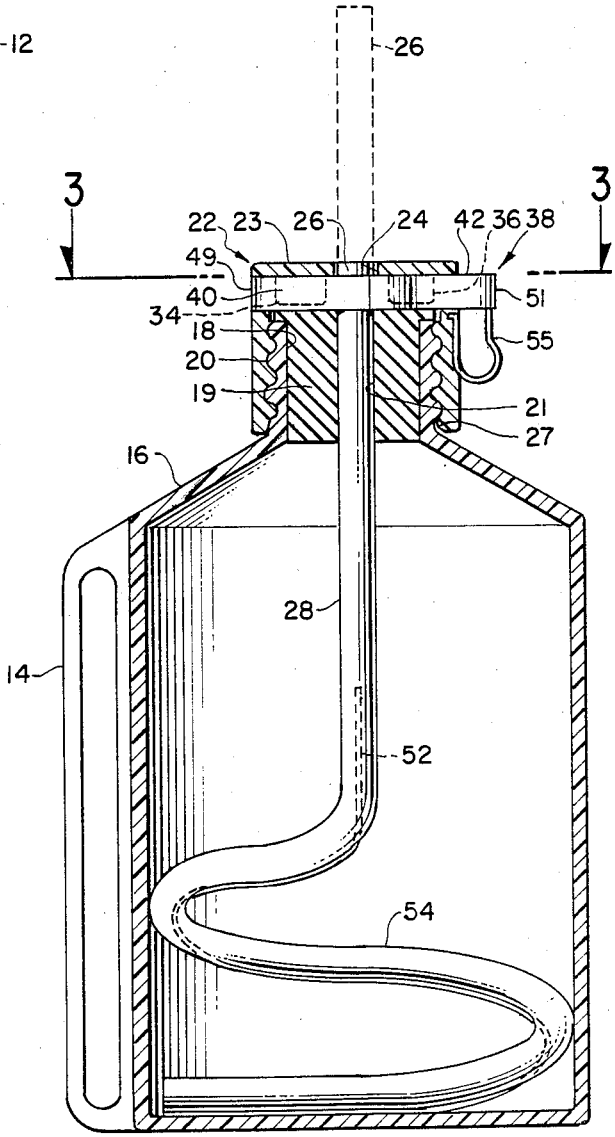
FIG. 2.

EMERGENCY FLASK FOR LIFE PRESERVERS

This invention relates to an emergency flask filled with a nutritious liquid for use with life preservers.

Emergencies happen very rapidly on a ship or on an airplane that has to make an emergency landing at sea. Under emergency situations there is seldom time to collect supplies that will be available for use in the water. Flasks filed with water or some other nutritious liquids can be prepared in advance, but it is necessary for the flank to be attached to the life preserver prior to the emergency and filled with a suitable liquid. But even if such flasks are available and are attached to a life preserver, prior to need they would still be difficult to use in the water. The reason is, an ordinary cap closing off the mouth of the flask, even if attached to the flask, could admit sea water into the flask making the liquid in the flask unusable, particularly if the sea is rough.

In the past, as exemplified by the U.S. Pat. Nos. 4,448,316, to Hiroshige, 3,776,458, to Chunga and 4,462,544, to Rutzel flasks have been equipped with straws which either spring out of the container upon removal of a seal or are pushed out by gap pressure, or can be simply pulled out. However such flasks were not suitable for use in an emergency situation , as when the life preserver and the flask are in sea water. For example the mouth of the Hiroshiga flask is enough larger than the diameter of the straw so that sea water could enter the flask unless the straw was forced back into the flask and the cap closed over the mouth of the flask. This could happen if the person in the water became unconscious leaving the flask open. Thus the contents of the flask would become contaminated and undrinkable.

Other flasks, as exemplified by the U.S. Pat. Nos. 4,462,4544, to Rutzel, 2,930,502, to Klein or 3,140,329 to Nutting come equipped with handles so that they could be attached to the straps of a life preserver.

What is needed therefore and comprises an important object of this invention is to provide a flask that can be easily attached to a life preserver and which has a normally closed valve mechanism attached to a straw which keeps the straw closed to prevent the entrance of sea water unless a positive force is exerted on the valve mechanism.

This and other objects of this invention will become more apparent when better understood in the light of the accompanying specification and drawing wherein:

FIG. 1 is a perspective view of a life preserve with a plurality of flasks attached to it.

FIG. 2 is an cross sectional view of the flask constructed according to the principles of this invention.

FIG. 3 is a sectional view taken on the line 3—3 of FIG. 2 and showing the valve mechanism in a straw closed position.

FIG. 4 is a sectional view showing the valve mechanism moved to a straw open position.

FIG. 5 is an exploded perspective view showing component of the flask cap and the straw closure mechanism.

Referring now to FIG. 1 of the drawing, a life preserver indicated generally by the reference numeral 10 is provided with straps 12 which are designed to be interconnected with the handle 14 on an emergency flask 16. The emergency flask is provided with a mouth portion 18 of the flask 16 having external threads 20. The mouth 18 is plugged by a stopper 19 which is press fit into the mouth of the flask 16. The stopper 19 has a centrally disposed hole 21 extending therethrough which communicates with the interior of the flask 16. As will be described below a straw 28 is coiled inside the flask 22 so the contents of the flask can be sucked out.

A cap 22 having a top wall or upper surface 23 and an attached depending cylindrical wall 25 which has internal threads 27 is threaded over the external threads 20 on the mouth portion 18 of the flask 16, see FIG. 2. The upper surface 23 of cap 22 is provided with a centrally disposed straw receiving hole 24 extending through the upper surface 23 and which is aligned with hole 21 in the stopper 19 through which the end portion 26 of the straw 28 extends. The external diameter of the straw 28 is generally equal to the internal diameter of the hole 21 so that when the flask becomes submerged, sea water cannot permeate the stopper 19 and contaminate the contents of the flask 16.

The cylindrical wall 25 of the cap is provided with aligned slots 30 and 32, see FIG. 5. In addition, support and guide members 34 and 36 depend from the upper surface 23 in alignment with the slots 30 and 32 and are positioned so they are on opposite sides of the straw receiving hole 24 in the cap.

An external valve actuating or straw pinching member 38 attached to the cap 22 comprises elongated oppositely extending wing members 40 and 42. The wing members comprise closely spaced parallel strips 41 and 43. The strips 42 and 43 in wing member 40 are separated by a distance less than the diameter of the straw to be used with the cap. These strips include facing arcuate portions 45 and 47 defining a straw receiving opening 44 between the wing members 40 and 42 through which the end portion 26 of the straw 28 extends, see FIG. 4. The end portion 26 of the straw is positioned so the facing edges of the aligned support and guide members are in close proximity to diametrically opposite sides of the end portion of the straw. After the staw closure member 38 is inserted in the cap 22, the ends of the wing members 40 and 42 of the valve actuating member may be joined together to form bow portions 49 and 51, see FIG. 5.

As shown in FIG. 2, the combined length of the wing members 40 and 42 is greater than the diameter of the cap 22 and the wing member 40 is longer than the wing member 42. To assemble the straw closure member 38 into the cap 22, the adjacent ends of the strips 41 and 43 are inserted through slot 30 from the inside of the cap until the opposite end of these strips with the support and guide members 34 and 36 between them, exit the cap through slot 32. In this way, when one wing member 42 is pressed against the side of the cap 22, the opposite wing member 40 extends out beyond the opposite slot 30 in the cap. The strips 41 and 43 are dimensioned, as shown in FIG. 4 so that when the end portion 51 of the wing member 42 is pressed against the side of the cap 22, the straw receiving opening 44 is aligned with the hole 24 in the cap and the hole 21 extending through the stopper 19, see FIG. 2. If the opposite end portion 49 is forced against the side of the cap 22, the straw receiving opening 44 is forced toward slot 32, see FIG. 2.

Prior to use, the end portion 26 of the straw is forced through the hole 21 in the stopper 19 and is positioned so it is generally aligned with the top edges of the strips 41 and 43. Then if the end portion 49 of the straw closure member 38 is forced against the cap 22, the strips 41 and 43 move so the end 26 of the straw 28 is forced between strips 41 and 43 which are spaced apart a distance such that the straw is releasably pinched shut so that sea water cannot enter the flask, see FIG. 3. In addition, as shown in FIGS. 1 and 2, when the end portion 26 of the straw is pinched shut, it is held below the top surface 23 of the cap 22. This arrangement protects the end 26 of the straw 28 from contamination and damage.

The opposite end 51 of the straw closure member 38 acts as a control member and when it is pressed against the side of the cap 22, the straw receiving opening is in alignment with the end 26 of the straw 28, as seen in FIG. 4, In this position the end 26 of the straw is no longer pinched shut and this allows access to the contents in the flask 16.

Referring now to FIG. 2, an elongated spring member 52 is cemented to a coiled portion 54 of the straw 28 inside the flask, in such a way that when the end 26 of the straw 28 is un pinched as shown in FIG. 4, the spring member 52 forces the end portion 26 of the straw 28 through hole 24 up beyond the upper surface of the cap 22 as shown in dotted lines. Thus a person in an emergency situation with the life preserver 10 so equipped can depress the end 51 of the end portion 26 of the straw closure element 58 and make use of the straw which will appear and be able to suck the contents of the flask through the straw 28.

Under dire circumstances, a person in the sea may become unconscious after pressing the end 51 of the straw closure member 38 to force it to the open position shown in FIG. 4. To prevent sea water from entering the flask, biasing means comprising a curved spring 55 is connected between the end 51 of the valve actuating member 38 and the support and guide member 36. As a result, some force is required to move the straw closure member 38 from the straw "closed" position shown in FIG. 3 to the straw "open" position in FIG. 4 because this movement compresses the spring 55. When the force is removed the compressed spring 55 retracts the straw closure member 38 from the position shown in FIG. 4 to the straw closed position shown in FIG. 3. With this arrangement, if the person in the water becomes unconscious the straw closure member 38 pinches the straw 28 shut thus preventing sea water from entering the flask.

The person in the water also has control over the flask so that after he has consumed enough of the contents of the flask, he can force the straw back into the cap against the force exerted by the spring 54 to close the flask.

It is contemplated that each life preserver could have one or more flasks attached to it as shown in FIG. 1. alternatively, life preservers designed only to hold a large numer of flasks could be assembled prior to an emergency so that in the event a boat sinks or a plane has to make a forced landing in the water, life preservers previously equipped with attached flasks will float around the scene of the accident to be captured by other survivors for their use.

Although as described above, the valve actuating or straw closing mechanism is externally attached to the straw, it is contemplated that a suitable mechanism which can perform the same function may be mounted inside the straw and act internally. For example, the cap could be somewhat elongated and cover the end portion of the straw which extends out beyond the mouth of the flask. A plug member could be attached to the inner surface of the cap in such a way that when the cap is inserted on the flask, the plug member could penetrate the interior of the end portion of the straw and close it off. Other ways to perform this straw closing function externally or internally of the straw may become apparent upon further reflection.

Having described the invention, what I claim as new is:

1. An emergency supply holder for a life preserver comprising a flask, a straw in the flask, means on said flask for attachment to a life preserver, said flask having a cap covering the mouth of said flask, said cap having an upper surface, a straw receiving hole extending through said upper surface, means for forcing the end portion of said straw to extend through said straw receiving hole in said upper surface of said cap, whereby the contents of said flask can be sucked out, said end portion of said straw extending far enough out of said cap so that a person using the flask can grasp the end portion of said straw and force it back into said flask below the upper surface of said cap to protect said end portion of said straw from contamination and damage, and means associated with said cap for pinching shut at least the end portion of said straw to prevent the entrance of sea water into said flask.

2. An emergency supply holder for life preservers comprising a flask, means on said flask for attachment to a life preserver, said flask having a cap covering the mouth of the flask, said cap having an upper surface, the upper surface of said cap having a straw receiving hole extending therethrough, a straw in said flask, pinching means engaging said straw both for releasably pinching shut said straw to prevent the entrance of sea water into the flask, and for holding the end portion of said straw below the upper surface of said cap to protect said end portion of said straw from contamination and damage, biasing means attached to said pinching means for biasing said pinching means so the straw prior to use is in a pinched closed position, and manually actuated control means attached to said pinching means for overcoming said biasing means to release the pinched portion of the straw, and means for forcing the end portion of said straw to extend through said straw receiving hole in said cap far enough above said upper surface of said cap so the contents of said flask can be sucked out.

3. An emergency supply holder for life preservers comprising a flask, means on said flask for attachment to a life preserver, said flask having a cap covering the mouth of the flask, said cap having an upper surface, the upper surface of said cap having a straw receiving hole extending therethrough, a flexible straw coiled in said flask, pinching means engaging said straw both for releasably pinching shut said straw to prevent the entrance of sea water into said flask, and for holding the end portion of said straw below the upper surface of said cap to protect said end portion of said straw from contamination and damage, a first spring attached to said pinching means for biasing said pinching means so the said end portion of the straw prior to use is in a pinched closed position, manually actuated control means attached to said pinching means for overcoming the biasing force exerted by said first spring to release the pinched shut portion of the straw, a second spring attached to at least a part of said straw in such a way that when the manually actuated control means overcomes said biasing means and releases the pinched end portion of the straw, said second spring forces the end portion of the straw through the straw receiving hole in the top surface of the cap so the contents of said flask can be sucked through said straw.

4. The emergency supply holder described in claim 3 wherein a cylindrical wall depends from said upper surface of said cap, aligned slots extending through said cylindrical wall, aligned support and guide members depend from the upper wall of the cap, said straw receiving hole in said top surface positioned so said aligned support and guide members are on opposite sides of said straw receiving hole in said cap, the said end portion of said straw positioned so the facing edges of said aligned support and guide members are in close proximity to diametrically opposite sides of said end portion of said straw, said pinching means comprising a valve actuating member consisting of oppositely extending wing members, said wing members comprising straight parallel strips positioned in spaced relationship on opposite sides of said support and guide members and joined together by a centrally disposed arcuate straw receiving opening, the periphery of said straw receiving opening in close proximity to and generally concentric with the periphery of the straw, the extreme ends of said valve actuating member extending out of said slots in such a way that forcing one of the wing members into one of said slots forces the opposite wing member out of said opposite slot and moves the end portion of the straw between said one of said parallel strips, the separation between at least one of the spaced parallel strips such that when the end portion of the straw is forced between said at least one of the spaced parallel strips, the end portion of the straw is pinched shut while the opposite wing member is forced out of the opposite slot in said cap, said opposite wing member comprising said control means, said end portion of said straw connected to said opposite wing member so when said opposite wing member is forced into said slot in said cap said straw is forced back into alignment with said straw receiving opening and the straw is no longer pinched shut, whereby the contents of the flask can be sucked through said straw, said first spring connected to said wing members in such a way that the end portion of the straw is held in a pinched closed position until manual force is exerted on the said opposite wing member to force the straw back into alignment with said straw receiving opening thereby permitting the contents of the flask to be sucked out so long as manual force is exerted on the opposite wing member.

5. A cap for the mouth of a flask, said cap comprising a top wall and a depending cylindrical wall, at least the lower portion of the cylindrical wall having threads for engagement with the threads on the mouth of the flask, aligned slots extending through the said cylindrical wall, aligned support and guide members transverse to said top wall, extending downward from said top wall in line with said aligned slots, a centrally disposed straw receiving hole extending through said top wall, said aligned support and guide members disposed on diametrically opposite sides of said hole, a valve actuating member comprising elongated oppositely extending wing members, each wing member comprising spaced parallel strips disposed on opposite sides of said support and guide members, at least one wing member having parallel strips in closely spaced relationship to each other separated from each other by a distance less than the diameter of a straw to be inserted through said hole in said cap, said parallel strips extending through said parallel slots and connected together by facing arcuate portions defining a straw receiving opening between said parallel strips, the length of said wing members larger than the diameter of said cap and disposed in such relationship to said straw receiving opening so that when one wing member is pressed against the cylindrical surface of the cap, a portion of the opposite wing member extends out of the opposite slot in said cap , so that by pushing one of the wing members, said straw receiving opening between said parallel strips is shifted from its position beneath the centrally disposed straw receiving hole extending through said top wall of said cap toward one of said aligned slots in said cylindrical wall of the cap.

6. A cap for fitting over the mouth of a flask, said flask comprising a top wall and a depending cylindrical wall, means on said cylindrical wall for attachment to the mouth of a flask, aligned slots extending through opposite sides of the cylindrical wall of the cap, support and guide members transverse to said top wall and aligned with said slots extending downward from said top wall, a centrally disposed straw receiving hole extending through said top wall, said aligned support and guide members disposed on diametrically opposite sides of said hole, a valve actuating member comprising elongated oppositely extending wing members, each wing member comprising closely spaced parallel strips disposed on opposite sides of said support and guide members, at least one of said wing members in closely spaced parallel relationship to each other and separated from each other by a distance less than the diameter of the straw to be inserted through said hole in said cap, said parallel strips connected together by centrally disposed facing arcuate portions defining a straw receiving opening between said parallel strips, the length of said wing members larger than the diameter of said cap and disposed in such relationship to said straw receiving opening so that when one wing member is pressed against the cylindrical surface of the cap, the opposite wing member extends out of the opposite slot in said cap, so that by pushing one wing member or the other, said straw receiving opening in said valve actuating member is shifted from a position in alignment with the straw receiving hole in the top wall of the flask toward one of the said aligned slots in said cap.

* * * * *